United States Patent [19]

Vasko et al.

[11] Patent Number: 4,683,709

[45] Date of Patent: Aug. 4, 1987

[54] SADDLE PAD

[75] Inventors: Tanya S. Vasko; Kent A. Vasko, both of 225 E. Pioneer Trail, Aurora, Ohio 44202

[73] Assignees: Tanya S. Vasko; Kent A. Vasko, both of Aurora, Ohio

[21] Appl. No.: 788,407

[22] Filed: Oct. 17, 1985

[51] Int. Cl.[4] ..... B68C 1/12

[52] U.S. Cl. ..... 54/66

[58] Field of Search ..... 54/37, 44, 65, 66

[56] References Cited

U.S. PATENT DOCUMENTS

| | | | |
|---|---|---|---|
| 218,217 | 8/1879 | Benoit | 54/65 |
| 297,486 | 4/1884 | Babcock | 54/66 |
| 804,671 | 11/1905 | Ransom | 54/65 |
| 1,266,812 | 5/1918 | Johnson | 54/65 |
| 1,338,931 | 5/1920 | Janicki | 54/65 |
| 3,971,194 | 7/1976 | Morgan | 54/66 |
| 4,346,205 | 8/1982 | Hiles | 528/53 |

FOREIGN PATENT DOCUMENTS

| | | | |
|---|---|---|---|
| 846844 | 9/1939 | France | 54/44 |

*Primary Examiner*—Robert P. Swiatek

*Attorney, Agent, or Firm*—Renner, Otto, Boisselle & Lyon

[57] ABSTRACT

This invention relates to a saddle pad and more particularly to an energy absorbing saddle pad which serves to minimize the amount of shock or energy transfer which occurs between a horse and its rider. The saddle pad, which is generally for use in conjunction with a saddle, comprises a soft moisture-absorbing layer for use next to the horse's coat and a tough abrasion resistant and absorbent layer for use next to the saddle. Included between the two layers are a pair of pockets each of which contains a removable and replaceable, lightweight, visco-elastic shock absorbing insert. The pockets are located within the pad such that when the pad is properly installed upon the horse the pockets align an insert on each side of the horse's spine in a position parallel and adjacent to the spine. Preferably, each side of the pad includes adjustable straps and a loop through which the lower portions of a saddle may be threaded to ensure the secure attachment of the pad to the saddle.

31 Claims, 9 Drawing Figures

SADDLE PAD

BACKGROUND

While riding a horse considerable amounts of energy or shock are transferred between the rider and the horse as a result of the repetitious upward and downward motion of the horse. Even greater amounts of energy are transferred between the rider and the horse when the horse undertakes such actions as jumping, turning, accelerating, decelerating, and the like. As a result of these transfers of energy the horses's muscular and skeletal systems undergo considerable strains. More particularly, these strains are known to manifest themselves in the form of chronic back pain. It is estimated that 80 percent of the performance type horses have some form of chronic back pain. Riders also are known to suffer from chronic back pain, coccygeal (tailbone) pain and pain in the gluteus maximus (buttocks).

The present invention, in an attempt to minimize the shock or energy transfer and its accompanying ill effects, provides an improved energy absorbing saddle pad for use on a horse or any other beast of burden.

SUMMARY OF THE INVENTION

In the present invention an improved saddle pad for use on a horse is provided for minimizing the amount of shock or energy transfered between the horse and its rider or other such load. The pad, which is generally for use upon a horse in conjunction with a saddle, comprises a layer of soft felt which is conducive to sweat absorption for use next to the horse's coat and a tough abrasion resistant and adsorbent layer for use next to the saddle. The two layers are securely attached to each other at various points along the pad including the perimeter which is reinforced with a tough abrasion resistant binding.

Included between the two outer layers of the pad are two pockets each of which contains a removable and replaceable, lightweight, visco-elastic shock absorbing insert. The pockets are located within the pad such that when the pad is properly installed upon the back of a horse the pockets align one insert on each side of the horse's spine in a position parallel and adjacent to the spine. The openings to each of the pockets may be equipped with resealable closures to facilitate the insertion and removal of the inserts for such purposes as cleaning or replacement. Since the invention provides for the replacement of the inserts the functional life of the pad is greatly improved. Therefore, if the pad is properly cared for its life may be several times that of the inserts.

The visco-elastic shock absorbing inserts must be constructed of a material capable of absorbing approximately fifty percent or more of the shock and distributing it in a multidimensional way, delaying the return of the remaining stored impact energy so that it does not snap back at the horse or the rider but recovering rapidly enough to be fully recovered for the next impact. A recovery delay of up to 300 milliseconds is acceptable, however, a recovery delay in the range of 10 to 20 milliseconds is preferred. An example of a material suitable for use in the construction of such a insert is a visco-elastic shock absorbing material sold under the trademark SORBOTHANE®. SORBOTHANE is a registered trademark of Sorbothane Inc. of Kent, Ohio, U.S.A.

Preferably, each side of the pad includes an adjustable strap and a loop through which the lower portions of a saddle may be threaded to ensure the secure attachment of the pad to the saddle.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
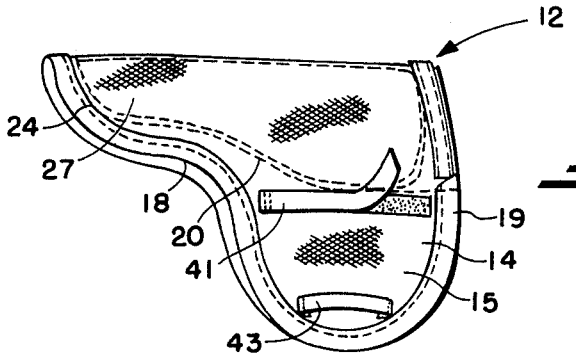
FIG. 1 is a side view of one preferred embodiment of the invention as it would appear on a horse's back.
Figure 2:
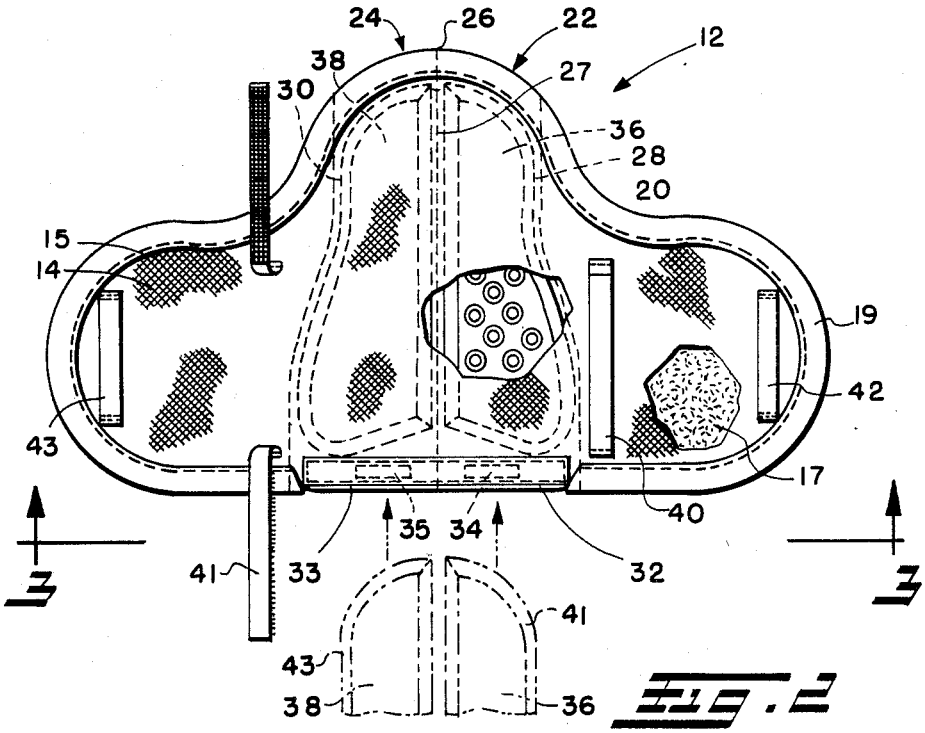
FIG. 2 is a top plan view of the pad of FIG. 1 including a view indicating the method of placing the inserts into the pockets, and two fragmentary views detailing one of the visco-elastic inserts and the layer of absorbent felt.
Figure 3:
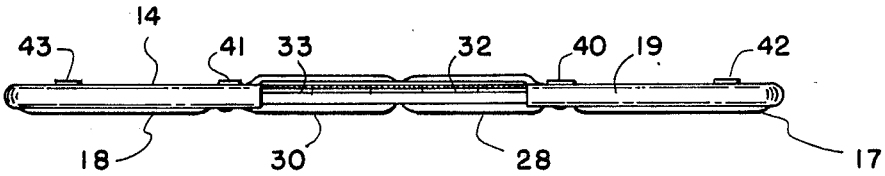
FIG. 3 is an end view of the pad of FIG. 2 taken on line 3—3 thereof.
Figure 4:
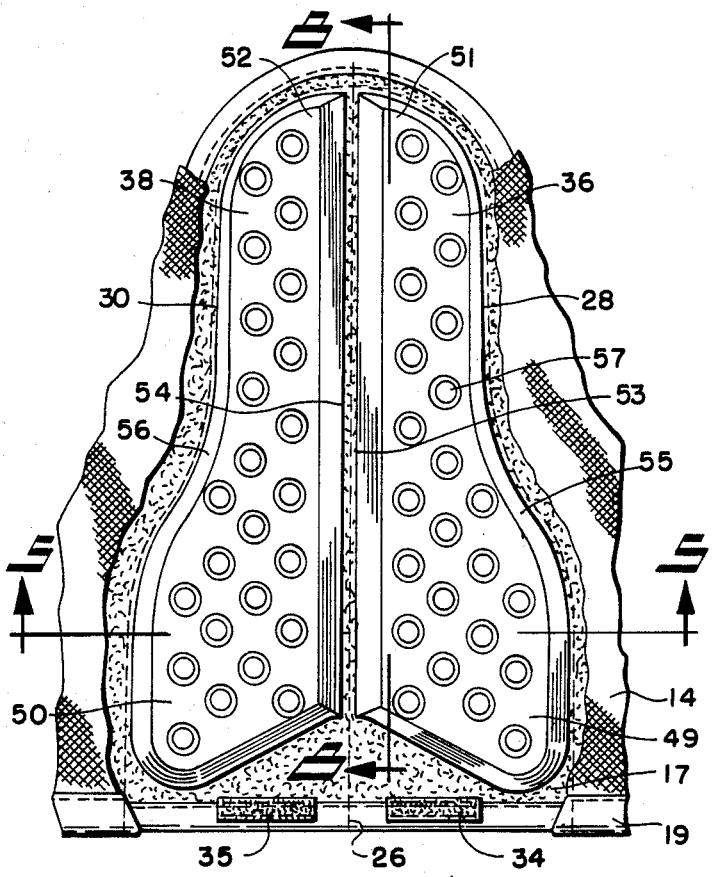
FIG. 4 is a fragmentary top view of the pockets and inserts of the pad of FIG. 1.

Referring in detail to the drawings and initially to FIG. 1, a saddle pad 12 made in accordance with the present invention is shown as it would appear upon proper installation on the back of a horse. The pad includes a tough abrasion resistant and adsorbent layer of fabric 14 on the top side 15 and a soft moisture absorbing layer of fabric 17 on the bottom side 18. The absorbent layer 17 allows the invention to absorb the horse's sweat as is anticipated by any conventional saddle pad. An example of just one type of material suitable for use in the mosture-absorbing layer 17 is a high quality wool felt. The abrasion resistant and adsorbent layer could be a woven nylon fabric, such fabric for example, being felt material sold under the trademark CAMBRELLE®. The layers 14 and 17 are securely attached to each other by a binding 19 which runs along the perimeter of the layers and by stitching 20 which runs throughout the pad.

The pad comprises two symmetrically opposed right hand and left hand parts, 22 and 24, separated by a centerline of stitching 26. The two parts come together at centerline 26 to form a protruding portion 27. Each part of the pad includes a pocket 28 and 30 with respective openings 32 and 33. The openings include resealable closures 34 and 35. Pockets 28 and 30 each contain a visco-elastic shock absorbing insert 36 and 38. By disengaging the closures 34 and 35, the inserts 36 and 38 may be easily inserted and removed from the pockets 28 and 30 via openings 32 and 33 to facilitate the cleaning of the pad and the inserts and also the replacement of the inserts. Since the inserts are removable and replaceable the functional life of the pad may be significantly extended. With proper care the life of the pad may be several times that of the inserts.

Preferably, each part of the pad includes an adjustable strap 40 and 41 and a loop 42 and 43 through which the lower portions of a saddle including the girth, may be threaded to ensure the secure attachment of the pad to the saddle. It will be appreciated that closures 34 and 35 and the adjustable straps 40 and 41 may comprise a variety of materials. However, such materials as hook and loop tapes sold under, for example, the trademark VELCRO ® are preferred.

The pad is easily installed upon a horse by first draping the pad over the center of a horse's back with the protruding portion 27 furthest from the horse's head and the bottom side 18 or the soft absorbent layer 17 in intimate contact with the horse's coat. The pad is then aligned upon the horse's back such that the centerline stitching 26 is adjacent and parallel to the horse's spinal vertebrae. The pockets are located immediately adjacent to and on each side of the centerline 26 so as to hold the inserts 36 and 38 parallel to and in immediate proximity to the horse's spine. This allows the load of the rider and the accompanying shock or energy transfers to be evenly distributed along the horse's back avoiding any undue abrasion of the thoracic spinal vertebrae.

The shock absorbing visco-elastic inserts may be constructed of a variety of energy absorbing materials capable of absorbing a significant portion of the shock or energy transferred between the rider and the horse. Such materials must also be capable of distributing the shock in a multi-dimensional manner and they should have a recovery delay long enough to avoid snapping back the shock to the rider but short enough to allow recovery before the next shock or energy transfer begins. Materials with a recovery delay up to 300 milliseconds are acceptable but a recovery delay in the range of 10 to 20 milliseconds is preferred. An example of a material suitable for use in the construction of such inserts is a visco-elastic shock absorbing material sold under the trademark SORBOTHANE ®. It will be appreciated, however, that other materials with similar properties are also well suited for the invention.

Referring now to FIGS. 4–9, the inserts 36 and 38 are shown to be wider at the front ends 49 and 50 and narrower at the back ends 51 and 52 with the major straight edges 53 and 54 extending parallel to the centerline of stitching 26. In this embodiment the edges 55 and 56 of the inserts are rounded. The geometric design of the insert is important because it must be such that maximum absorption of shock can occur with the least amount of energy abosrbing material as possible. Such geometry includes frustoconical depressions, one of which is indicated at 57. The depressions 57 have no right angles and include slightly radiused corners 58 and 59 so as to prevent the formation of stress risers which would tear and eventually wear out the insert. The pockets 28 and 30 are shaped to the approximate configuration of the inserts 36 and 38 to prevent any unnecessary movement of the inserts within the pockets and thus avoid abrading the outer surfaces of the inserts.

Figure 8:
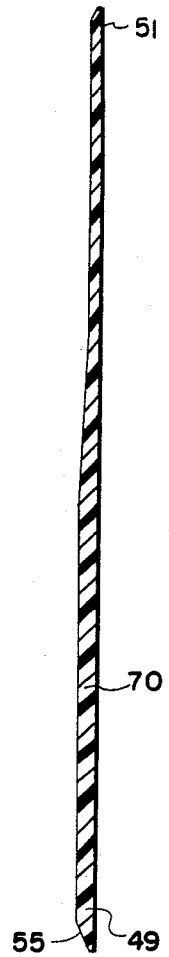
FIG. 8 is a sectional side view of the insert of FIG. 4 taken on line 8—8 thereof.
Figure 5:
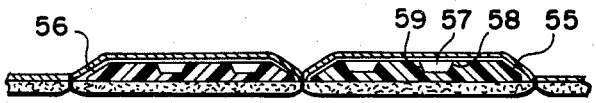
FIG. 5 is a sectional end view of FIG. 4 taken on line 5—5 thereof.
Figure 6:
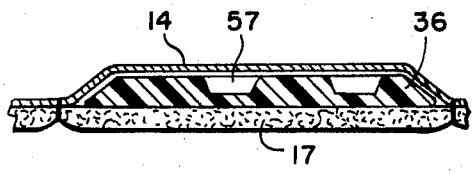
FIG. 6 is a sectional end view of one of the inserts and pockets shown in FIG. 5 in the uncompressed position.
Figure 7:
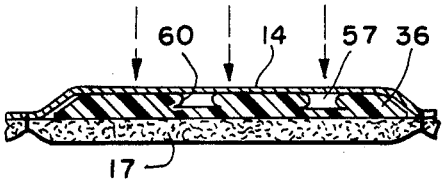
FIG. 7 is a sectional end view of the insert and pocket shown in FIG. 6 in the compressed position after a load has been applied.

In FIG. 6 one of the inserts 36 is shown in the uncompressed position before any transfer of energy or loading has occurred. In FIG. 7 the insert 36 is shown immediately after loading, the insert deforming under the load as shown at 60. In FIG. 8 a sectional view of the major length of the insert 36 is shown. In this embodiment of the invention the thickness 70 has been decreased from the front end 49 of the insert to the back end 51. This allows the bulk of the energy absorbing material to be concentrated where the maximum amount of shock or energy transfer is experienced. It will be appreciated though that the configuration of the inserts 36 and 38 may vary widely. For example, depending on the type of horse and saddle being used, the inserts may be rectangular-shape. Additionally, for particular applications the inserts may be the same thickness throughout or they may employ depressions 55 with depths and configurations quite unlike that illustrated. For example, such alternate forms of the depressions may be elongated or polygonal or more specifically pyramid or sphere-shaped.

Figure 9:
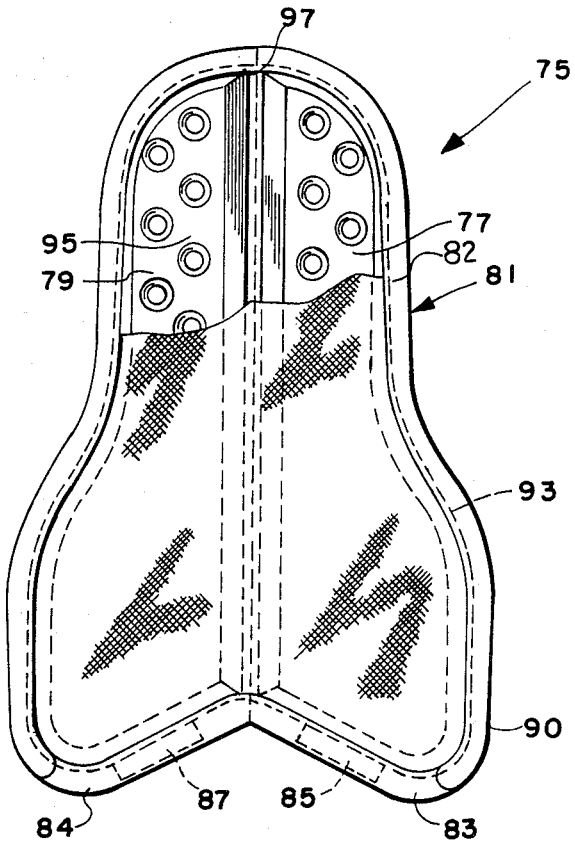
FIG. 9 is a top plan view of another embodiment of the invention with the top surface of the saddle pad broken away.

In FIG. 9 there is illustrated an energy absorbing saddle pad 75 which does not include any of the additional features which the saddle pad illustrated in FIGS. 1–8 includes. This alternate embodiment of the invention comprises nothing more than a pair of visco-elastic energy absorbing inserts 77 and 79 and a holder 81 which holds the inserts in a symmetrically opposed position parallel and adjacent to the horse's spinal vertebrae. The holder 81 includes openings 83 and 84 and closures 85 and 87 to facilitate the insertion and removal of the inserts 77 and 79 for purposes of cleaning and replacement. The holder 81 also includes a top layer of tough abrasion resistant and adsorbent fabric broken away at lines 82 to expose the inserts and a bottom layer of soft moisture absorbent material which is not illustrated. The two layers are bound together with a tough abrasion resistant binding 90 and stitching 93.

The saddle pad 75 is easily installed upon a horse by first placing the pad in the center of the horse's back with the narrow portion 95 farthest from the horse's head and the soft absorbent layer closest to the horse's coat. The pad 75 is then aligned upon the horse's back such that the centerline stitching 97 is adjacent and parallel to the horse's spinal vertebrae. The energy absorbing pad 75 may be attached to either a saddle or a conventional saddle pad by use of various devices such as straps, buckles, snaps, and the like.

It may be desirable to employ this embodiment of the invention under conditions where a full pad would be unacceptable such as when racing. This embodiment may also be employed in a situation where one desires to use a conventional saddle pad having a special design, color, or insignia, and thus wants to keep the energy absorbing pad 75 out of sight completely hidden by the saddle or a conventional saddle pad.

It will be appreciated that although the focus of the preceding discussion has been upon the use of this invention upon a horse's back, this invention is also applicable to use upon the backs of other animals or beasts of burden, such as donkeys, burros, camels, and the like, which carry riders or similar loads.

It will also be appreciated that in cases where a saddle pad with no moisture absorbing qualities is desired, the top and bottom layers of the energy absorbing saddle pad may both be constructed of a tough abrasion resistant material or vice versa.

Additionally, it will be appreciated that the pockets do not have to be located between the top and bottom layers of the pad. The pockets may just as easily be placed on the outside of one of the layers and be covered with an additional or third layer of fabric.

Finally, it will be appreciated that the pockets and inserts may be of such configuration that one embodiment of the invention may comprise a single pocket and a single insert or another embodiment may comprise a single pocket and two separate inserts and yet another embodiment may comprise multiple pockets and inserts.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A saddle pad and the like comprising two symmetrical parts having pockets formed therein and separated from each other along the position of the spine of the horse, each of said pockets including a visco-elastic shock absorbing insert comprising a visco-elastic shock absorbing material capable of distributing shock in a multi-dimensional manner and an opening to facilitate the insertion and removal of said visco-elastic shock absorbing insert.

2. A saddle pad as set forth in claim 1 wherein said openings of said pockets include resealable closures to securely hold said visco-elastic shock absorbing inserts upon insertion in said pockets.

3. A saddle pad as set forth in claim 1 wherein said visco-elastic shock absorbing inserts include depressions for improved energy absorbing characteristics.

4. A saddle pad as set forth in claim 3 wherein said depressions are frustoconical-shape.

5. A saddle pad as set forth in claim 3 wherein said depressions include radiused edges to minimize the formation of stress risers.

6. A saddle pad as set forth in claim 1 wherein said visco-elastic shock abosrbing inserts have a recovery delay of less than 300 milliseconds.

7. A saddle pad as set forth in claim 1 wherein said visco-elastic shock absorbing inserts have a recovery delay in the range of 10 to 20 milliseconds.

8. A saddle pad as set forth in claim 1 wherein said saddle pad includes at least one layer of moisture absorbing material.

9. A saddle pad as set forth in claim 8 wherein said layer of moisture absorbing material comprises wool felt.

10. A saddle pad as set forth in claim 1 wherein said saddle pad comprises washable materials.

11. A saddle pad as set forth in claim 1 further comprising a reinforcing binding along the perimeter of said saddle pad.

12. A saddle pad as set forth in claim 1 wherein said saddle pad further includes at least one adjustable strap for securing said saddle pad to the girth of a saddle.

13. A saddle pad as set forth in claim 1 wherein said saddle pad further includes at least one adjustable strap and at least one loop for securing said saddle pad to the girth of a saddle.

14. A saddle pad as set forth in claim 1 wherein said saddle pad includes at least one layer of tough abrasion resistant and adsorbent fabric.

15. An energy absorbing saddle pad for use upon the back of a horse comprising a left hand portion and a symmetrically opposed right hand portion, said right hand and said left hand portions each including a top layer, a bottom layer, and a pocket, each of said pockets including a visco-elastic shock absorbing insert comprising a visco-elastic shock absorbing material capable of distributing shock in a multi-dimensional manner and having a front end, a back end and a major straight edge.

16. An energy absorbing saddle pad as set forth in claim 15 wherein said pockets are located within each of said portions such that upon proper installation of said energy absorbing saddle pad upon said horse each of said pockets is located on opposite sides of the spinal vertebrae of said horse.

17. An energy absorbing saddle pad as set forth in claim 16 wherein each of said pockets includes an opening to facilitate the insertion and removal of said visco-elastic shock absorbing insert.

18. An energy absorbing saddle pad as set forth in claim 16 wherein each of said openings of said pockets further includes a resealable closure device to ensure the secure retention of said visco-elastic shock absorbing inserts in said pockets.

19. An energy absorbing saddle pad as set forth in claim 18 wherein said visco-elastic shock absorbing inserts are narrower in width at said back end and wider in width at said front end.

20. An energy absorbing saddle pad as set forth in claim 19 wherein said pockets are shaped to the approximate configuration of said visco-elastic shock absorbing inserts.

21. An energy absorbing saddle pad as set forth in claim 20 wherein the major straight edge of each of said visco-elastic shock absorbing inserts extends adjacent to the spinal vertebrae of said horse upon proper installation of said energy absorbing saddle pad on said horse.

22. An energy absorbing saddle pad as set forth in claim 21 wherein said visco-elastic shock absorbing inserts include depressions and said depressions are of various depths.

23. An energy absorbing saddle pad as set forth in claim 22 wherein said visco-elastic shock absorbing inserts include rounded edges.

24. An energy absorbing saddle pad as set forth in claim 23 wherein the thickness of said visco-elastic shock absorbing inserts decreases from said front end to said back end of said visco-elastic shock absorbing inserts.

25. An energy absorbing saddle insert including a front end and a back end comprising a visco-elastic shock absorbing material capable of distributing shock in a multi-dimensional manner for use in conjunction with an energy absorbing saddle pad.

26. An energy absorbing saddle insert as set forth in claim 25 wherein said energy absorbing saddle insert is wider in width at said front end and narrower in width at said back end.

27. An energy absorbing saddle insert as set forth in claim 26 further including depressions to improve the energy absorbing characteristics of said energy absorbing saddle insert.

28. An energy absorbing saddle insert as set forth in claim 27 wherein said depressions are frustoconical-shape.

29. An energy absorbing saddle insert as set forth in claim 28 wherein said depressions are of different depths.

30. An energy absorbing saddle insert as set forth in claim 29 wherein said depressions include radiused corners.

31. An energy absorbing saddle insert as set forth in claim 30 wherein the thickness of said energy absorbing saddle insert decreases from said front end to said back end.

* * * * *